US006089786A

United States Patent [19]

Allen et al.

[11] Patent Number: 6,089,786

[45] Date of Patent: Jul. 18, 2000

[54] DUAL ROTOR RIDING TROWEL WITH PROPORTIONAL ELECTRO-HYDRAULIC STEERING

[75] Inventors: J. Dewayne Allen, Paragould, Ark.; Michael W. McKean, Arlington, Tenn.; Timmy D. Guinn, Paragould, Ark.

[73] Assignee: Allen Engineering Corp., Paragould, Ak.

[21] Appl. No.: 09/285,194

[22] Filed: Mar. 29, 1999

Related U.S. Application Data

[63] Continuation-in-part of application No. 08/784,244, Jan. 15, 1997, Pat. No. 5,890,833.

[51] Int. Cl.[7] ..... B01D 11/00

[52] U.S. Cl. ..... 404/112; 404/112

[58] Field of Search ..... 404/112

[56] References Cited

U.S. PATENT DOCUMENTS

| | | | |
|---|---|---|---|
| D. 323,510 | 1/1992 | Allen et al. | D15/10 |
| 3,936,212 | 2/1976 | Holz, Sr. et al. | 404/112 |
| 4,046,484 | 9/1977 | Holz, Sr. et al. | 404/112 |
| 4,312,603 | 1/1982 | Whiteman, Jr. | 404/112 |
| 4,556,339 | 12/1985 | Morrison | 404/112 |
| 4,676,691 | 6/1987 | Morrison | 404/112 |
| 4,710,055 | 12/1987 | Maass et al. | 404/112 |
| 4,775,306 | 10/1988 | Kikuchi et al. | 425/62 |
| 5,108,220 | 4/1992 | Allen et al. | 404/112 |
| 5,238,323 | 8/1993 | Allen et al. | 404/85 |
| 5,480,257 | 1/1996 | Allen | 404/112 |
| 5,480,258 | 1/1996 | Allen | 404/112 |
| 5,584,598 | 12/1996 | Watanabe et al. | 404/112 |
| 5,613,801 | 3/1997 | Allen | 404/112 |
| 5,685,667 | 11/1997 | Allen | 404/112 |
| 5,816,739 | 10/1998 | Allen | 404/112 |

*Primary Examiner*—Eileen Dunn Lillis
*Assistant Examiner*—Raymond Addie
*Attorney, Agent, or Firm*—Stephen D. Carver

[57] ABSTRACT

A high performance, twin rotor riding trowel for finishing concrete and a joystick operated electro-hydraulic control circuit enabling complete joystick control to the operator. The rigid trowel frame mounts two spaced-apart, downwardly projecting, and bladed rotors that frictionally contact the concrete surface. The rotors are tilted with double acting, hydraulic cylinders to effectuate steering and control. Double acting hydraulic cylinders also control blade pitch. A joystick system enables the operator to hand control the trowel with minimal physical exertion. The proportional joystick system directly controls electrical circuitry that outputs proportional control signals to electrically controlled, proportional, pressure-reducing valves in line with the tilting cylinders. The hydraulic circuitry comprises a motor driven pump delivering pressure to a flow divider circuit. A bypass-valve in line before the flow divider enables an operator to customize the trowel steering characteristics.

20 Claims, 7 Drawing Sheets

DUAL ROTOR RIDING TROWEL WITH PROPORTIONAL ELECTRO-HYDRAULIC STEERING

CROSS-REFERENCE TO RELATED APPLICATION

This application is a continuation in part of our prior U.S. application Ser. No. 08/784,244, Filed Jan. 15, 1997, and entitled Hydraulically Controlled Riding Trowel now U.S. Pat. No. 5,890,833.

BACKGROUND OF THE INVENTION

1. Field of the Invention

This invention relates generally to motorized riding trowels for finishing concrete surfaces of the type classified in United States Patent Class 404, Subclass 112. More particularly, our invention relates to twin-rotor riding trowels comprising joystick-activated, fluid operated systems for controlling steering.

2. Description of the Prior Art

It is well established in the art that freshly placed concrete must be appropriately finished to achieve the desired smoothness and flatness. Motorized riding trowels are particularly effective for finishing concrete. They can finish large surface areas of wet concrete more efficiently than older "walk behind" trowels. Significant savings are experienced by the contractor using such equipment, as time constraints and labor expenses are reduced.

Typical motorized riding trowels employ multiple, downwardly projecting rotors that are gimbaled to the frame for pivoting. The rotors contact the concrete surface for finishing concrete and support the weight of the trowel. Typically, each rotor comprises a plurality of radially spaced apart finishing blades that revolve in frictional contact with the concrete surface. The blades may be coupled to circular finishing pans for treating green concrete. The rotors and their revolving blades are responsible for steering and propulsion. When the rotors are tilted, the differential forces generated upon the concrete by the revolving rotor blades generate steering and propulsion moments.

As freshly poured concrete "sets", it soon becomes hard enough to support the weight of motorized trowels. Preferably, the finishing process starts with panning while the concrete is still "green", within one to several hours after pouring depending upon the concrete mixture involved. The advent of more stringent concrete surface finish specifications using "F" numbers to specify flatness (ff) and levelness (fl), dictates the use of pans on a widespread basis. Both "super-flat" and "super-smooth" floors can be achieved by panning with motorized trowels.

Pan finishing is normally followed by medium speed blade finishing, after the pans are removed from the rotors. A developing technique is the use of "combo blades" during the intermediate "fuzz stage" as the concrete continues to harden. So-called "combo-blades" are a compromise between pans and normal finishing blades. They present more surface are to the concrete than normal finishing blades, and attack at a less acute angle. The rotors are preferably turned between 100 to 135 RPM at this time. Finishing blades are then used, and they are rotated between 120 to 150 RPM. Finally, the pitch of the blades is changed to a relatively high contact angle, and burnishing begins. This final trowel finishing stage uses rotor speeds of between 135 and 165 RPM.

Motorized riding trowels are ideal for finishing large areas of plastic concrete quickly and efficiently, and a variety of self propelled riding trowels are known in the art.

Holz, in U.S. Pat. No. 4,046,484 shows a pioneer, twin rotor, self-propelled riding trowel wherein the rotors, gimbaled to the frame, are appropriately tilted to generate steering forces. U.S. Pat. No. 3,936,212, also issued to Holz, shows a three rotor riding trowel powered by a single motor. Although the design depicted in the latter two Holz patents were pioneers in the riding trowel arts, the devices were relatively difficult to steer and control.

Prior U.S. Pat. No. 5,108,220 owned by Allen Engineering Corporation, the same assignee as in this case, relates to an improved, fast steering system for riding trowels. Its steering system enhances riding trowel maneuverability and control. The latter fast steering riding trowel is also the subject of U.S. Des. Pat. No. 323,510 owned by Allen Engineering Corporation. U.S. Pat. No. 5,613,801, issued Mar. 25, 1997 to Allen Engineering Corporation discloses a power-riding trowel equipped with separate motors for each rotor. These designs employ upwardly projecting, manually deflected levers for steering and control.

Allen Engineering Corporation U.S. Pat. No. 5,480,258 discloses a multiple engine riding trowel. The twin rotor design depicted therein associates a separate engine with each rotor. As the engines are disposed directly over each revolving rotor assembly, horsepower is more efficiently transferred to the revolving blades. Besides resulting in a faster and more efficient trowel, the design is easier to steer. Again, manually activated steering linkages are used.

Allen Engineering Corporation U.S. Pat. No. 5,685,667 discloses a twin engine riding trowel using "contra rotation." Many trowel users prefer the steering characteristics that result when the trowel rotors are forced to rotate in a direction opposite from that normally expected in the art.

Modern large, high power riding trowels are noted for their speed, horsepower, and efficiency. To be effective they must be highly maneuverable and easy to operate. The steering must be fast and responsive. The trowel must be capable of operation over a variety of engine speeds. Further, all of the foregoing characteristics must be preserved whether the trowel is finishing with pans, combo-blades, or normal finishing blades of a variety of sizes. Generally speaking, the more powerful the trowel, the faster finishing operations can be completed. However, with more power it becomes harder to control and properly steer the machine. Crisp, responsive handling is important to optimize the efficiency of the troweling process, and to preserve operator safety and comfort.

The rotors in many of the previously discussed patents are tilted with manually operated levers that project upwardly from the machine frame. The operator manually controls the levers to deflect linkages below the trowel frame that tilt the rotors. Where separate engines are used with each rotor assembly, the added weight requires additional physical effort to tilt the rotors for steering, or to vary blade pitch. It is clear that to meet all of the demands placed upon the modern riding trowel, a powered steering system must be perfected.

Hence we have designed a twin rotor riding trowel with an optimized steering control system. The titling cylinders are controlled proportionally, and direct hydraulic-joystick systems are employed. Our hydraulic steering system is "backwards compatible" dual-rotor trowels. Our system can be adjusted to readily adapt itself for use with finishing pans, combo blades, or normal blades. Further, it readily adapts itself to drivers of different weight. Handling characteristics can be somewhat customized to approximate the desired "feel" of the individual driver by our new "select steering" system.

SUMMARY OF THE INVENTION

Our new twin-rotor riding trowel maximizes operator control. The preferred trowel comprises a pair of spaced apart rotors gimbaled to the frame. The bladed rotors contact the concrete surface and rotate simultaneously. The trowel may use one or more internal combustion engines to power the dual rotors. Joysticks, conveniently placed near the operator, activate suitable electro-hydraulic components that tilt the rotors for steering and control. With our joystick system, older, cumbersome manually operated steering levers are replaced.

Thus our dual-rotor riding trowel is fully "powered" for automatic control. Hydraulic circuitry that is electrically controlled by joysticks facilitates steering and propulsion by tilting the rotors. Optionally the system remotely varies and controls blade pitch. Preferably, proportional, pressure-reducing valves are in line with the double acting tilting cylinders. Hand-operated joystick assemblies output proportional electrical signals that control the reducing valves. Hydraulic pressure is obtained from a suitable pump driven by a trowel engine. Trowels may be equipped with either one or two internal combustion engines powered by gasoline, diesel fuel, or gas. Adequate horsepower abounds for powering the hydraulic motors. Therefore, the operator can steer the device with a minimum of physical effort.

Thus, a fundamental object of the invention is to provide a dual rotor-riding trowel with quick and responsive power steering. It is a feature of this invention that "joystick steering" is employed for ultimate trowel ride control.

Another fundamental object is to provide proportional power steering in dual-rotor riding trowels.

A further object is to provide an electric-over-hydraulic steering and control system for riding trowels that is joystick-controlled.

A related object is to provide a joystick-controlled, electric-over-hydraulic steering system for riding trowels that is backward compatible with older lever-steered riding trowels that lack power steering.

Another important object is to simplify the operation of high power, dual rotor trowels.

A related object is to reduce the physical effort required to safely drive a twin-rotor riding trowel.

Another basic object is to provide a power steering system for a high speed trowel that quickly and efficiently delivers its considerable horsepower to multiple rotor assemblies.

It is also an object to provide power steering for twin-engine riding trowels that works efficiently while running either conventional blades, combo-blades, or finishing pans.

A still further object is to provide a hydraulic steering circuit of the character described that will function on a variety of riding trowels, including power trowels with multiple internal combustion engines, and trowels that use either gearbox-powered or hydraulically-driven rotors.

Another important object is to provide a high power riding trowel that overcomes power-draining vacuum effects that occur when panning wet concrete.

Another basic object is to provide a power steering system for twin rotor riding trowels that works with either standard rotation or counter-rotation.

Another important object is to provide a power steering and control system for riding trowels that is electrically operated through joystick controllers.

Yet another important object is to provide a power steering equipped riding trowel wherein the rotors flatten the concrete surface sufficiently to attain the high "F-numbers" (i.e., flatness characteristics) that are established by certain ACl regulations.

Another object of the present invention is to provide a trowel of the character described that is inherently stable and easy to control and steer.

A related object is to provide a twin-engine riding trowel that is ideal for quick curing concrete jobs.

These and other objects and advantages of the present invention, along with features of novelty appurtenant thereto, will appear or become apparent in the course of the following descriptive sections.

BRIEF DESCRIPTION OF THE DRAWINGS

In the following drawings, which form a part of the specification an are to be construed in conjunction therewith, and in which like reference numerals have been employed throughout in the various views wherever possible.

DETAILED DESCRIPTION

Figure 1:
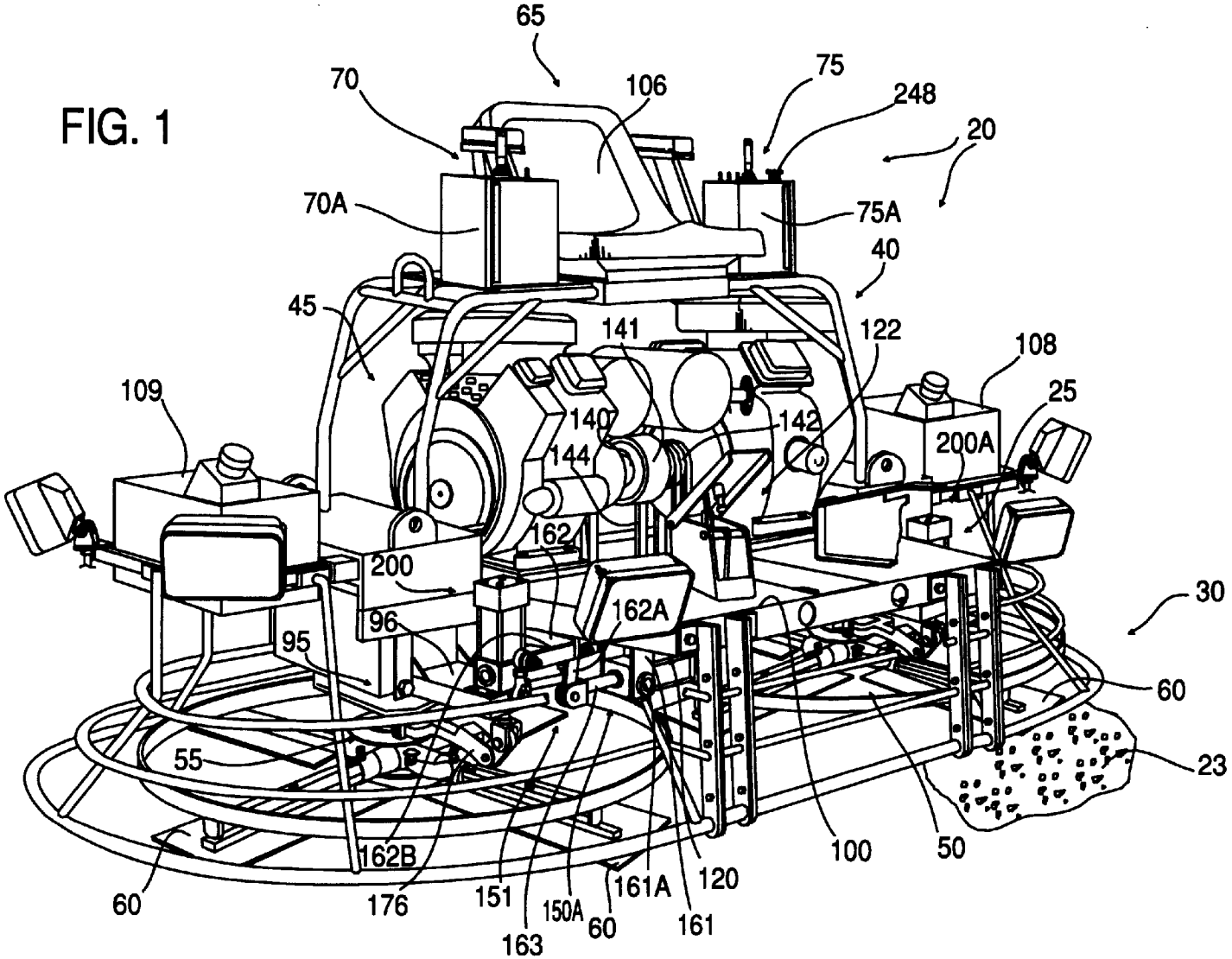
FIG. 1 is a frontal isometric view of a twin-rotor riding trowel showing the best mode of our electro-hydraulic joystick steering system.

With initial reference now directed to FIGS. 1–4 of the accompanying drawings, a twin rotor riding trowel is broadly designated by the reference numeral 20. Substantial structural details of twin rotor riding trowels are set forth in prior U.S. Pat. Nos. 5,108,220, 5,613,801, 5,480,257, and 5,685,667 which, for disclosure purposes, are hereby incorporated by reference herein. These patents explain in detail how the rotors may be suspended from the frame for gimbaled movement.

Riding trowel 20 comprises a metal frame 25 (FIGS. 1, 3) surrounded by a guard cage 30 (FIGS. 1–3) that protects its periphery. The spaced-apart, left and right rotors 50, 55 are each gimbaled to the frame and project downwardly into contact with concrete surface 23. Several radially spaced apart blades 60 extend outwardly from each of the rotors 50, 55. The blades 60 frictionally contact the concrete surface 23 to be finished an support the trowel 20 and the operator. An operator station 65 mounts on the tip of the frame. As illustrated, frame 25 mounts a pair of internal combustion engines 40, 45 that drive the counter-rotating, rotors, 50, 55 as described in U.S. Pat. No. 5,685,667. However, it will be appreciated that the instant invention is of equal utility in conjunction with single engine riding trowels, with either normal rotation or contra rotation, an with gasoline, diesel powered, or alternative engines.

The controls are easily reached by a seated operator at station 65. The operator steers trowel 20 with joysticks 70, 75 (FIG. 1). Left joystick 75 and right joystick 70 (i.e., from the point of view of a seated operator) are secured to control housings 75A and 70A respectively that shroud the hydraulic actuators and hydraulic hoses that the joysticks control. The right joystick 70 can be pushed forwardly or pulled rearwardly, and it may be moved to the operator's left and right. Left joystick 75 need only move forwards or backwards. Such joystick movement helps make the trowel backwards compatible with older, lever-steered trowels that lack power steering.

Figure 2:
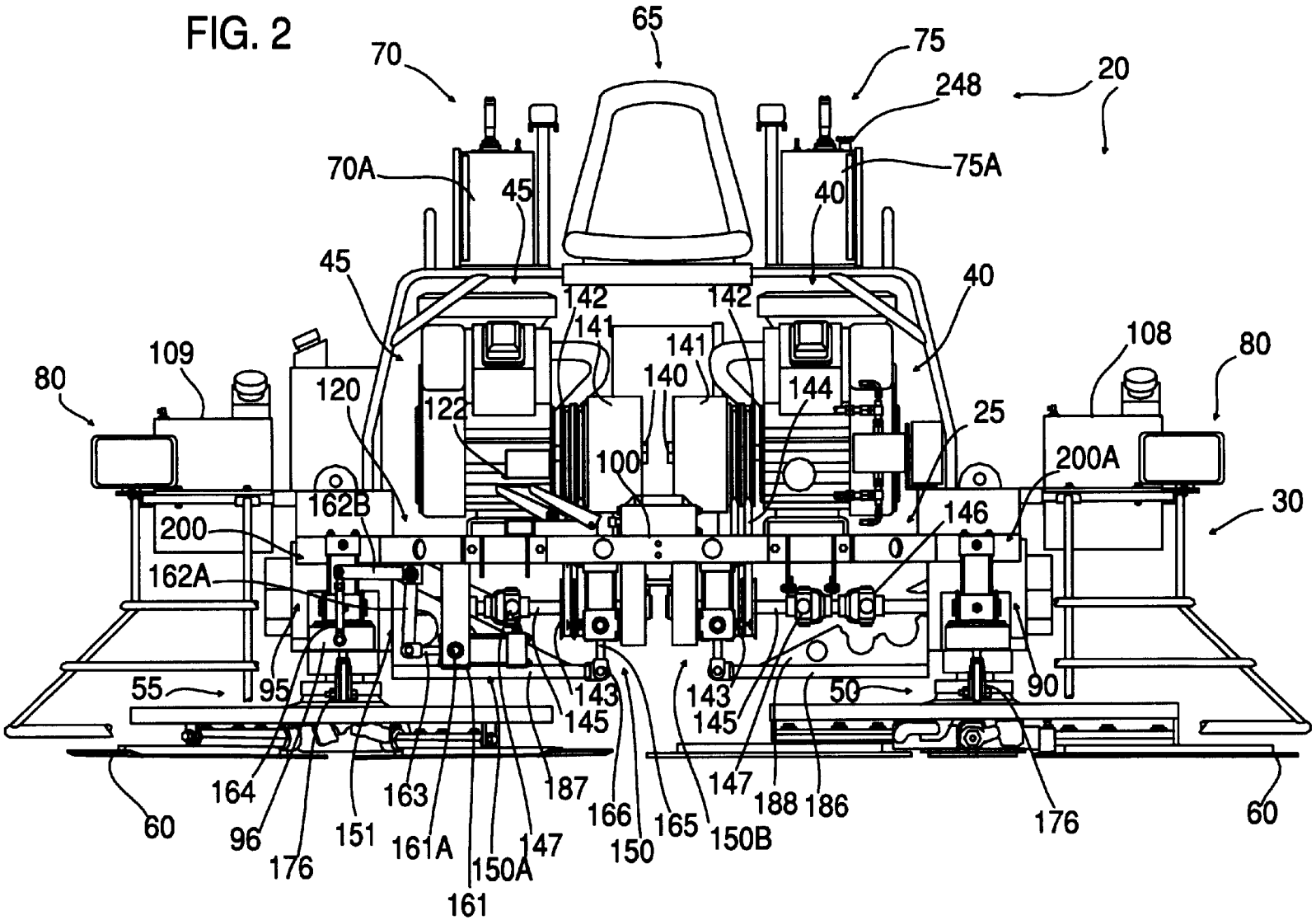
FIG. 2 is a partially fragmentary, front elevational view with portions omitted for simplicity and/or broken away for clarity.
Figure 3:
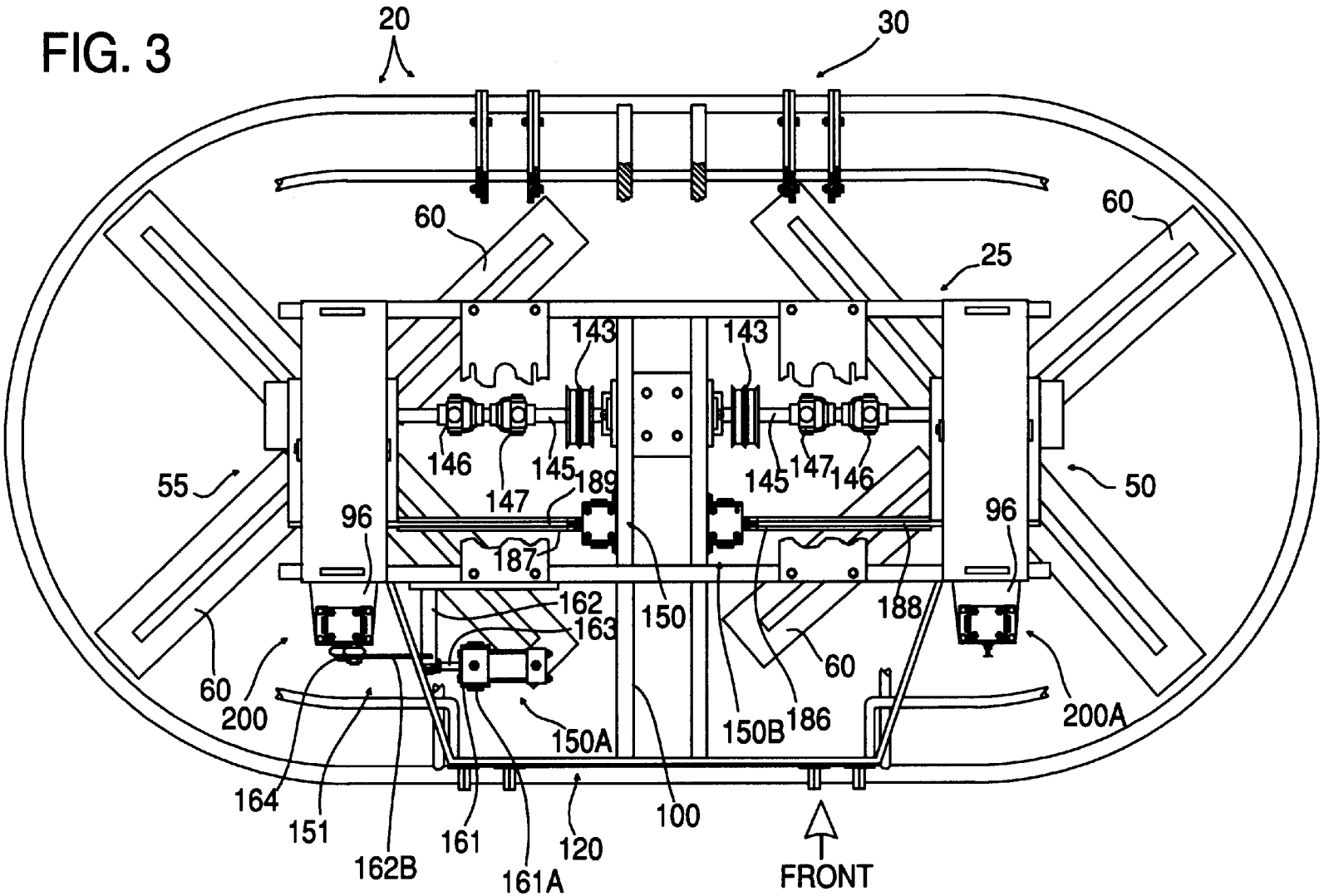
FIG. 3 is a fragmentary, top plan view with portions thereof broken away or shown in section for clarity.

The gearboxes 90, 95 (FIG. 2) control the angle or degree of tilt of the rotors 50, 55 to generate steering forces. They are gimbal-mounted to the frame in the manner taught in the aforementioned patents. The longitudinal pitch of each blade 60 may also be manipulated to further control the trowel 20 and the finish imparted to the concrete surface 23 (FIGS. 1 and 2).

The frame 25 comprises an upper deck 100 that provides a mounting surface and a seat 106 to permit the operator to ride the trowel. Conventional engine controls and gauges (not shown) are conveniently mounted adjacent the seat 106 within or upon housings 70A, 75A. Two gas tanks 108 and 109 are mounted on opposite frame ends. Optional drive lights 80 are positioned near the gas tank. A forward subframe 120 (FIG. 2) projecting from the frame 25 mounts a throttle pedal 122. The throttle peddle 122 evenly controls the flow of fuel from the gas tanks 108, 109 to the internal combustion engines 40, 45 to ensure that the rotors 50, 55 rotate substantially uniformly.

Figure 4:
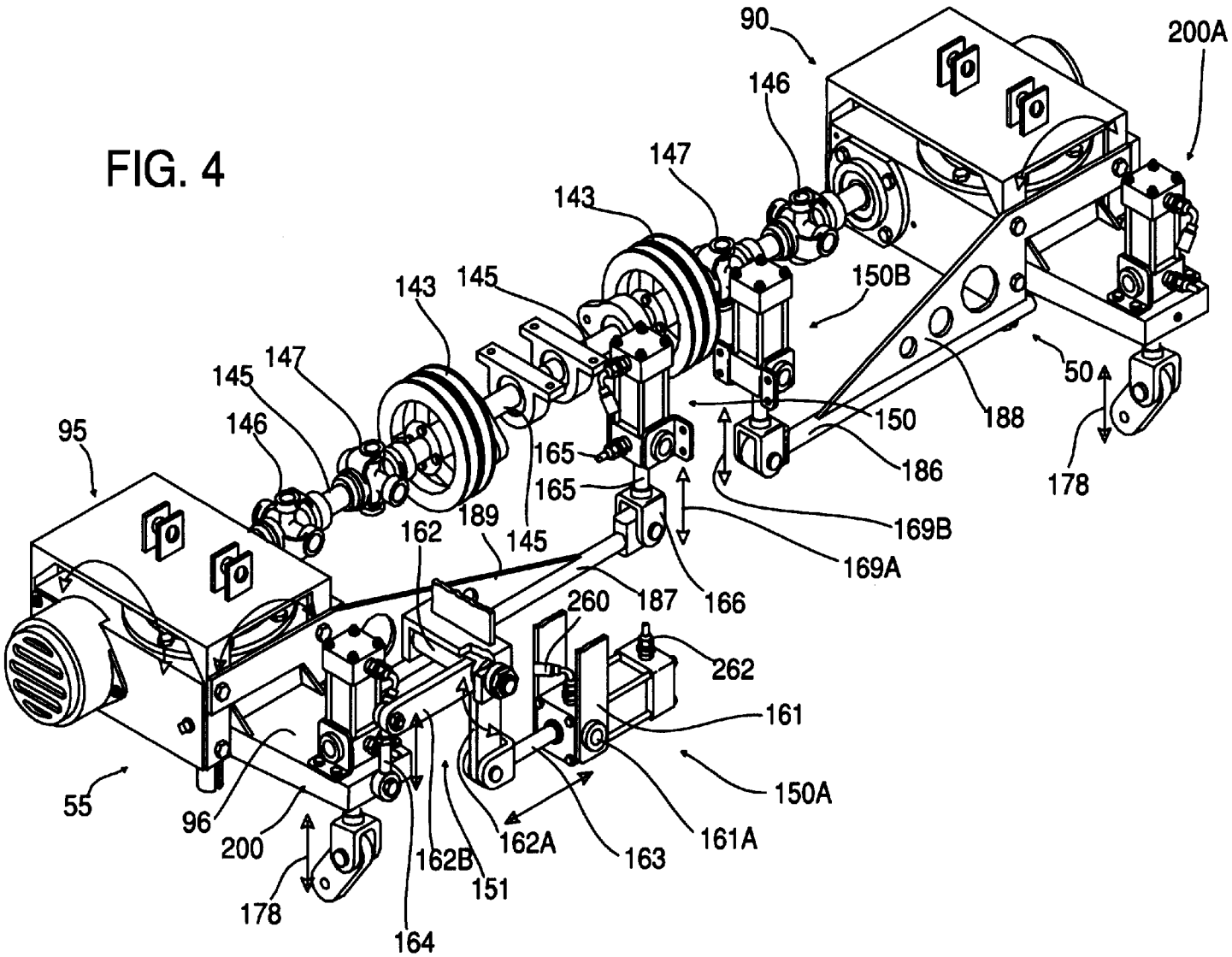
FIG. 4 is an enlarged, fragmentary exploded view of the preferred drivetrain and associated hydraulic cylinders.

The drivetrain of FIG. 4 has been discussed in detail in the aforementioned patents. Its purpose is to drive the gearboxes to rotate the rotors in response to the internal combustion motors. In the best mode (i.e., for trowel designs not involving hydraulically-driven rotors) each engine output shaft 140 (FIG. 2) 45 drives a clutch 141 that controls a drive pulley 142 (FIG. 2). A conventional fan belt 144 entrained about upper pulley 142 and lower pulley 143 rotates a driveshaft 145 (FIG. 4). Belts 144 can slip to prevent engine damage. The use of drive belts 144 also permits the engines 45 to be mechanical displaced slightly forwardly or rearwardly without altering the driveshaft or gearbox positions.

Driveshaft 145 extends into a rotor gearbox 90 or 95 (FIG. 4) through a U-joints 146, 147. The driveshaft axes of rotation are generally parallel to the engine axes of rotation. U-joints 146, 147 allow slight, operational displacements of the gearbox 95 relative to the input shaft pulley 143. Preferably, right gearbox 95 tilts right to left and front to back, whereas left gearbox 90 tilts only left to right. The left and right rotors thus both tilt in a plane parallel with or coincident to the hypothetical biaxial plane established by the axis of rotation of the rotors. When deflected by cylinders 150, 150B (FIG. 4), the elongated torque rods 186, 187 (FIG. 4) extending from the gearboxes 90, 95 tilt the rotors in a plane parallel to and/or coincident with the biaxial plane. The torque rods 186, 187, that function as the preferred levers, are generally aligned and extend along the bottom of gussets 188, 189 (FIGS. 3, 4) projecting from the gearboxes. The rods 186, 187 are also offset from the axis of rotation defined within the steering boxes as disclosed in the above referenced patents. Gearbox 95 and the right rotor 55 are tilted in a plane perpendicular to the biaxial plane with hydraulic cylinder 150A that lifts or lowers a projection 96 from gearbox 95 through linkage 151 (FIG. 4).

Cylinder 150A is preferably oriented horizontally for clearance purposes (FIG. 4). It is secured to brace 161 by pivot 161A. Ram 163 terminates in a clevis connected to arm 162A welded to sleeve 162. Cooperating are 162B emanating from sleeve 162 drives a Heim joint 164 coupled to projection 96. Cylinder 150A ultimately moves projection 96 (FIG. 4) up and down to tilt the right side rotor in a plane perpendicular to the biaxial plane. This tilting motion is primarily responsible for left and right movements. Alternatively, cylinder 150A could be oriented vertically.

Cylinders 150 and 150B (FIG. 4) lift the torque rods 187 or 186 to forcibly rock the rotors in a plane parallel to and/or coincident with the biaxial plane. The rocking is primarily responsible for forward and reverse movements. The latter cylinders are preferably mounted vertically. The terminal clevis 166 on ram 165, for example, is directly pivoted to the end of torque rod 187. Thus a rocking movement in the direction of arrows 169A, 169B is established (FIG. 4). Trowel movements generally correspond to the direction joysticks are deflected. However, steering response (i.e., the amount of deflection of the tilting cylinders) is generally proportional to how far the joystick levers are moved.

Blade pitch control cylinders 200, 200A, (FIG. 3) preferably mounted vertically, change blade pitch by deflecting conventional pitch control forks 176 (FIG. 1) as indicated by arrow 178 (FIG. 4). Trowel blade pitch control is thoroughly discussed in the previously cited patent documents.

Figure 5:
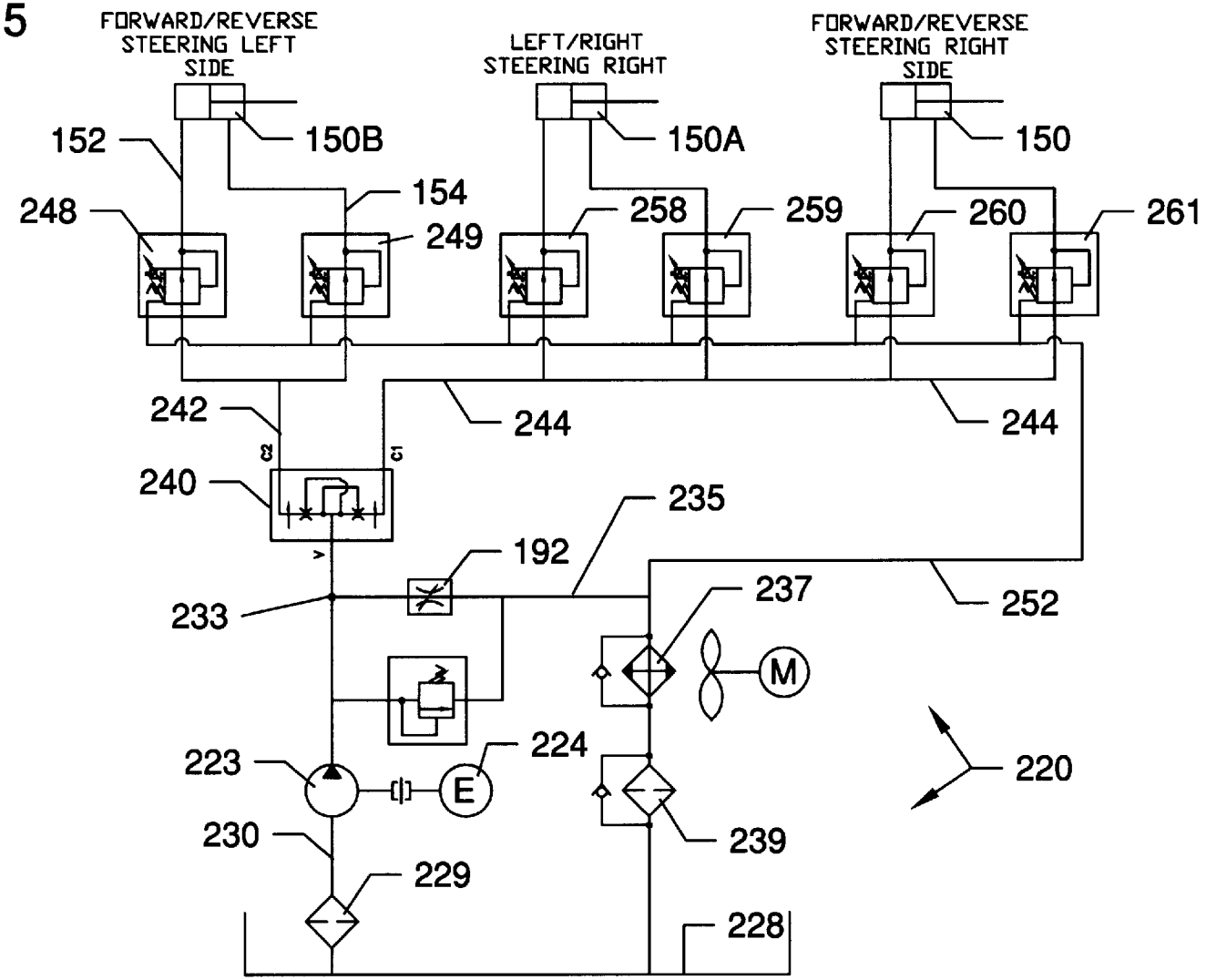
FIG. 5 is a schematic diagram of the preferred hydraulic circuitry.
Figure 6:
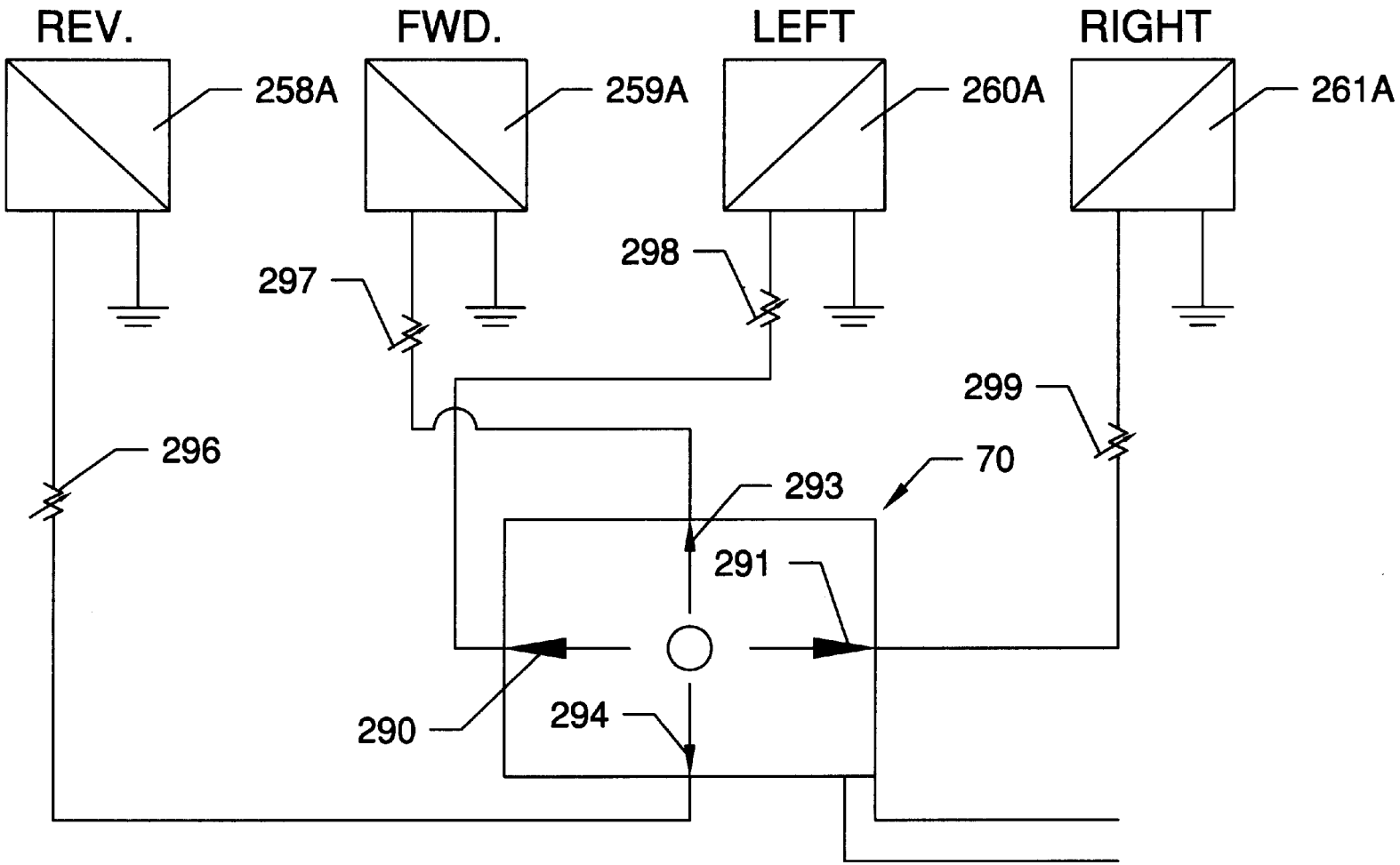
FIG. 6 is a is a diagrammatic electrical diagram of the right joystick assembly; and, FIG. 7 is a diagrammatic electrical diagram of the left joystick assembly.
Figure 7:
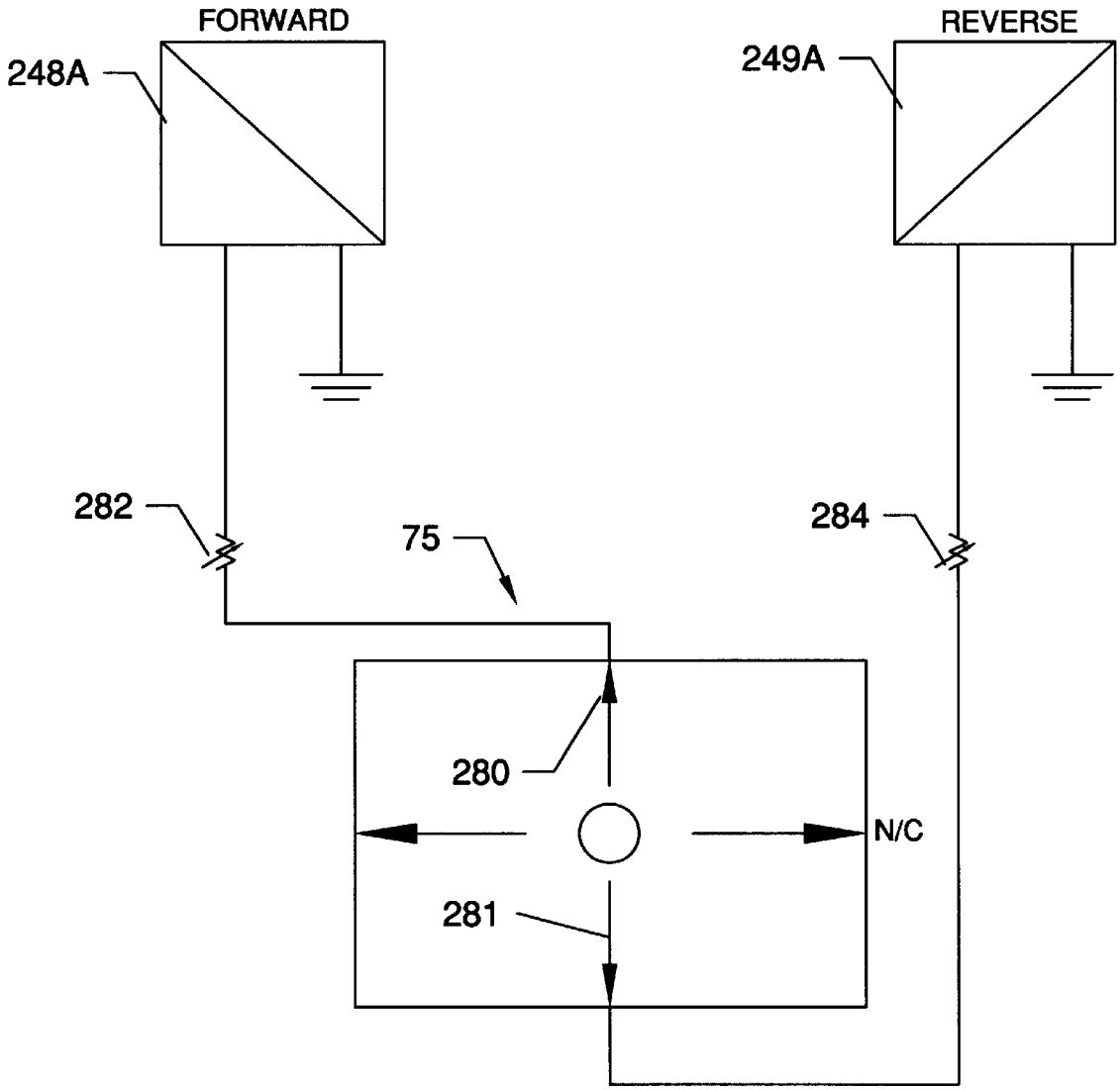

Referring now to FIGS. 5–7, the preferred hydraulic circuit 220 (FIG. 5) comprises a hydraulic pump 223 driven by a motor 224 (which comprises one of the rotor drive motors). Motor 224 drives the pump through coupler-adaptor 225. Pump 223 suctions fluid from reservoir 228 through suction strainer 229 and line 230. The pump output reaches junction 223 coupled to a bypass needle valve 192 that provides variable, selectable steering. Valve 192 is mechanically adjustable, and it is preferably located adjacent the driver so he can adjust his steering response speed. Valve 192 drains through line 235, return line oil cooler 237 and return line filter 239. The hydraulic flow rate and load experienced by the trowel depends upon numerous factors including the type of blade or pans chosen, the weight of the operator, and the hardness of the concrete being treated. Valve 192 provides a convenient means for the driver to quickly adapt flow rates to his operating conditions. It is preferred that this bypass valve be plumbed in immediately after the pump and before the flow dividers.

High pressure from junction 233 is also applied to flow divider 240 that outputs on lines 242 and 244. Line 242 feeds electro-hydraulic, pressure-reducing valves 248, 249 respectively connected to lines 152, 154 that control the left side tilting cylinder 150B. Line 244 feeds electro-hydraulic, pressure-reducing valves 258, 259, 260, and 261. Valves 258 and 259 control tilting cylinder 150A at the front of the right rotor to tilt it in a plane perpendicular to the biaxial plane. Valves 260 and 261 control right rotor tilting cylinder 150. Valves 248, 249, and 258–261 drain through return line 252 that dumps into reservoir 228 through cooler 237 and filter 239.

Valves 248, 249, and 258–261 are proportionately activated by electric current applied to their corresponding field coils 248A, 249A (FIG. 7) and 258A–261A (FIG. 6). The amount of voltage applied to the field coils controls the current through them, and the concomitant flow rate thought the associated valve. When the field coils are energized, hydraulic flow through the corresponding valves is enabled in a direction towards the respective tilting cylinder. When a given field coil 248A, 249A and/or 258A–261A is deenergized (i.e., no voltage is applied), the fluid flow direction is reversed, i.e., the valve associated with a deenergized field coil drains back into the reservoir 228.

As seen in FIG. 7, the left joystick 75 can move frontwards and backwards, as indicated generally by arrows 280, and 281. The joystick mechanisms operate current control devices, shown schematically as potentiometers 282 and 284, that control current to fields 248A and 249A (FIG. 16). As seen in FIG. 15, the right joystick controller assembly 70 can move left and right, as indicated generally by arrows 290, and 291, or it can move frontwards and backwards, as indicated generally by arrows 293, 294. The joystick mechanisms operate current control potentiometers 296–299, that control current to fields 258A–261A (FIG. 7). The direction of joystick movement corresponds to the direction of resultant trowel movement.

As a result of the aforedescribed joystick arrangement, the amount of deflection physically applied by the trowel driver to the joystick lever will be proportionately reflected in the amount of tilt cylinder expansion or retraction. Thus, the relative position of the steering joysticks is directly proportionately related to position of the tilting cylinders, and the corresponding tilting orientation of the rotor assemblies.

Blade pitch may be controlled hydraulically with separate valves disclosed in our prior U.S. application Ser. No. 08/784,244, filed Jan. 15, 1997, entitled Hydraulically Controlled Riding Trowel, U.S. Pat. No. 5,890,833, which is hereby incorporated by reference.

OPERATION

In operation a variety of operator precautions must be observed, as is the case with prior art motorized trowels. The hydraulic tanks should be periodically inspected for proper level, and the rotor blades must be changed as necessary after routine inspections for wear. Fuel tank levels must be sufficient for extended periods of use. During the initial finishing of wet concrete, proper pans will first be installed on the rotors by coupling the rotor blades to the radially spaced apart brackets provided.

Normally the engines are started one at a time. With all engines running, throttle control of each occurs concurrently by pressure on the foot control. Once the engines are running, suitable throttle speed will be sufficient to activate the clutches causing rotor rotation. Once the rotors are activated, the joystick controls activate cylinders 150, 150A, and 150B to steer and control the trowel by tilting the rotors. Because of the inherent "backwards compatibility" established by the steering controls, the required hand movements for steering and control are the same as required with older two rotor machines that steer with large, manually deflected levers. The joystick assemblies 70 and 75 control steering. Once the becomes operator familiar with the general handling characteristics of the trowel, the "select steering" valve 192 should be adjusted to tailor steering and handling to the operator's preferences.

If pressure is applied to the inside or outside of the left and right rotors by tilting them appropriately with the double action cylinders, then the machine will move forward or backwards. This occurs when the joysticks are pushed forwardly or pulled rearwardly. In the best mode known at this time, during forward or reverse travel the front cylinder 150A that is largely responsible for left and right movement is neutral. To move left or right, subsequent tilting of the right rotor with cylinder 150A to concentrate pressure at its front or rear (i.e., depending on whether contra rotation or standard rotation is used) will cause the trowel to make left or right turns. As is well recognized by those skilled in the art, by varying the inclination of the rotors in a plurality of other combinations, a wide variety of trowel maneuvers can be executed.

From the foregoing, it will be seen that this invention is one well adapted to obtain all the ends and objects herein set forth, together with other advantages which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. For a self propelled finishing machine of the type comprising a frame, internal combustion engine means secured to said frame, a plurality of revolving, bladed, rotor assembles pivoted to said frame and driven by said engine means, a power steering system comprising:

pump means driven by said internal combustion engine means for supplying hydraulic pressure;

hydraulic circuit means powered by said pump means for operating the power steering system, said circuit means comprising:

tilting cylinder means for tilting the rotor assemblies to effectuate trowel steering and maneuvering;

proportional, pressure reducing valve means for controlling said tilting cylinder means; and, electric circuit means for selectively activating said valve means;

left and right joysticks accessible to a trowel operator for operating said circuit means whereby the operator of the trowel can steer and control the riding trowel hydraulically; and, wherein the left and right joysticks move generally with the same mechanical hand-lever movements necessary for steering manual steering riding trowels thereby establishing backwards compatibility said electric circuit means comprises an electric field coil for selectively activating each proportional, pressure-reducing valve.

2. The steering system as defined in claim 1 wherein said hydraulic circuit means further comprises select steering valve means that is adjustable by an operator to tailor trowel steering characteristics to his or her taste.

3. The steering system as defined in claim 1 wherein:

said tilting cylinder means comprises a plurality of hydraulic cylinders, one for each rotor assembly, each tilting cylinder comprising a pair of hydraulic connection lines;

said proportional, pressure reducing valve means comprises a pair of proportional, pressure reducing valves in fluid flow communication with said tilting cylinders and in-line with said hydraulic connection lines.

4. The steering system as defined in claim 3 wherein hydraulic fluid flow output from said proportional, pressure reducing valves is enabled to said tilting cylinders when said electric field coils are activated.

5. The steering system as defined in claim 4 wherein the hydraulic fluid flow output from said proportional, pressure reducing valves delivered to said tilting cylinders is proportional to the current applied to said electric field coils.

6. The steering system as defined in claim 4 wherein hydraulic fluid flow return drainage through said proportional, pressure reducing valves from said tilting cylinders occurs when said electric field coils are not energized.

7. The steering system as defined in claim 6 wherein the hydraulic fluid flow output from said proportional, pressure reducing valves delivered to said tilting cylinders is proportional to the current applied to said electric field coils.

8. The steering system as defined in claim 7 wherein:

said trowel frame comprises a plurality of rotor assembly mounting regions, each rotor assembly comprises a motor driven gear box and a pivot steering box of generally U-shaped cross section for securing the gear box;

each pivot steering box comprises trunnions pivoted to said frame for supporting the rotor assembly and enabling pivoting in response to said cylinder means; and said trowel comprises pivot stop means for mechanically limiting gear box pivoting.

9. A high power, twin rotor riding trowel for finishing a concrete surface, said riding trowel comprising:

a rigid, generally frame having a front, a rear, and a left side and right side;

a rotor assembly pivotally suspended from the left side and the right side of the frame, each rotor assembly comprising a plurality of radially spaced apart blades for frictionally contacting the concrete;

internal combustion motor means for powering said trowel;

hydraulic pump means driven by said motor means for supplying hydraulic pressure;

hydraulic circuit means powered by said pump means for power steering, said hydraulic circuit means comprising:

tilting cylinder means for tilting the rotor assemblies to effectuate trowel steering and maneuvering;

proportional, pressure reducing valve-activated means for controlling said tilting cylinder means; and, electric circuit means for selectively activating said valve means;

left and right joysticks accessible to a trowel operator for operating said electric circuit means whereby the operator of the trowel can steer and control the riding trowel hydraulically; and, wherein the left and right joysticks move generally with the same mechanical hand-lever movements necessary for steering manual steering riding trowels thereby establishing backwards compatibility said proportional pressure reducing valve means comprises a pair of proportional pressure reducing valves in fluid flow communication with said tilting cylinders as in-line with a plurality of hydraulic connection lines.

10. The riding trowel as defined in claim 9 wherein said hydraulic circuit means further comprises select steering valve means that is adjustable by an operator to tailor trowel steering characteristics by increasing or decreasing the proportional, pressure reducing valves' response to the movements of the joysticks.

11. The riding trowel as defined in claim 9 wherein:

said tilting cylinder means comprises a plurality of hydraulic cylinders, one for each rotor assembly, each tilting cylinder comprising a pair of hydraulic connection lines; and, said electric circuit means comprises an electric field coil for selectively activating each proportional, pressure-reducing valve.

12. The riding trowel as defined in claim 11 wherein hydraulic fluid flow output from said proportional, pressure reducing valves is enabled to said tilting cylinders when said electric field coils are activated.

13. The riding trowel as defined in claim 12 wherein the hydraulic fluid flow output from said proportional, pressure reducing valves delivered to said tilting cylinders is proportional to the current applied to said electric field coils.

14. The riding trowel as defined in claim 12 wherein hydraulic fluid flow return drainage through said proportional, pressure reducing valves from said tilting cylinders occurs when said electric field coils are not energized.

15. The riding trowel as defined in claim 14 wherein the hydraulic fluid flow output from said proportional, pressure reducing valves delivered to said tilting cylinders is proportional to the current applied to said electric field coils.

16. The riding trowel as defined in claim 15 wherein:

said trowel frame comprises a plurality of rotor assembly mounting regions, each rotor assembly comprises a motor driven gear box and a pivot steering box of generally U-shaped cross section for securing the gear box;

each pivot steering box comprises trunnions pivoted to said frame for supporting the rotor assembly and enabling pivoting in response to said cylinder means; and said trowel comprises pivot stop means for mechanically limiting gearbox pivoting.

17. A motorized riding trowel for finishing a concrete surface, said riding trowel comprising:

a rigid frame;

a seat on said frame for supporting an operator of said riding trowel;

a pair of spaced apart rotor assemblies for powering said riding trowel and frictionally contacting said concrete, the rotor assemblies mounted to said frame, each rotor assembly comprising a plurality of radially spaced apart blades for frictionally contacting the concrete being finished;

motor means for powering the rotor assemblies;

pump means driven by said motor means for supplying hydraulic power;

a plurality of hydraulic cylinders for selectively tilting said rotor assemblies for steering, each cylinder controlled by a pair of hydraulic lines connected to it;

electrically-controlled, proportional, pressure reducing valves in series with said hydraulic lines connected to said cylinders for proportionately extending or retracting each cylinder;

electrical circuit means for operating said pressure reducing valves by supplying a electrical signal; and, joysticks for selectively activating said electrical circuit means, proportional movements of said joysticks corresponding generally to proportional movements of the tilting cylinder means.

18. The riding trowel as defined in claim 17 further comprising:

a flow divider connected between said pump means and said pressure reducing valves; and, select steering valve means that is adjustable by an operator for tailoring trowel steering characteristics to his or her taste, said select steering valve means connected between said flow divider and aid pump means.

19. The riding trowel as defined in claim 18 wherein:

said electric circuit means comprises an electric field coil for selectively activating each proportional, pressure-reducing valve;

hydraulic fluid flow output from said proportional, pressure reducing valves is enabled to supply fluid flow said tilting cylinders when said electric field coils are activated; and, hydraulic fluid flow output from said proportional, pressure reducing valves delivered to said cylinders is variably proportional to the current applied to said electric field coils.

20. The riding trowel as defined in claim 19 wherein hydraulic fluid flow return drainage through said proportional, pressure reducing valves from said tilting cylinders occurs when said electric field coils are not energized.

* * * * *